US005628514A

United States Patent [19]

Nguyen et al.

[11] Patent Number: 5,628,514

[45] Date of Patent: May 13, 1997

[54] METHOD OF PLAYING ASIAN HIGH-LOW CARD GAME

[76] Inventors: Son H. Nguyen, 11052 Stonecress, Fountain Valley, Calif. 92708; Hai Q. Huynh, 2695 Norcross Dr., San Jose, Calif. 95148

[21] Appl. No.: 574,645

[22] Filed: Dec. 19, 1995

[51] Int. Cl.[6] ..... A63F 1/00

[52] U.S. Cl. ..... 273/292; 273/306

[58] Field of Search ..... 273/292, 274, 273/309, 306

[56] References Cited

U.S. PATENT DOCUMENTS

| | | | |
|---|---|---|---|
| 5,368,305 | 11/1994 | Rodda et al. | 273/292 |
| 5,397,128 | 3/1995 | Hesse et al. | 273/292 |
| 5,494,295 | 2/1996 | Potter | 273/292 |
| 5,503,401 | 4/1996 | Nguyen | 273/306 |

OTHER PUBLICATIONS

"Bacc–Jack", Casino Gaming Concepts, Inc., 1995.

*Primary Examiner*—Benjamin H. Layno
*Attorney, Agent, or Firm*—Kenton R. Mullins

[57] ABSTRACT

The method of playing a card game using a card deck of 360 cards which consists of 15 modified conventional decks. Each modified conventional deck has all seven, eight, nine, ten, jack, queen, and king cards removed therefrom. Thus, each modified conventional deck comprises only 24 cards. The card game is played according to either a high winning scheme wherein the best hand is a point total of twelve and the worst hand is a point total of two, or a low winning scheme wherein the best hand is a point total of two and the worst hand is a point total of twelve. The banker may arbitrarily choose either winning scheme, the chosen winning scheme being common to all the players and banker. After the winning scheme is determined, the first round of two cards is dealt face down to all players (betting players and banker). The players add the values of the cards in their hands. Eleven is subtracted whenever a hand total is greater than twelve. The players then determine whether an additional card is desired. This determination will likely be affected by whether the high winning scheme or the low winning scheme has been set. The hands of the various players are then compared with the hands of the banker, and winners are declared who have hands that are better than the banker's hand, according to the selected predetermined winning scheme.

22 Claims, 1 Drawing Sheet

Fig. 1
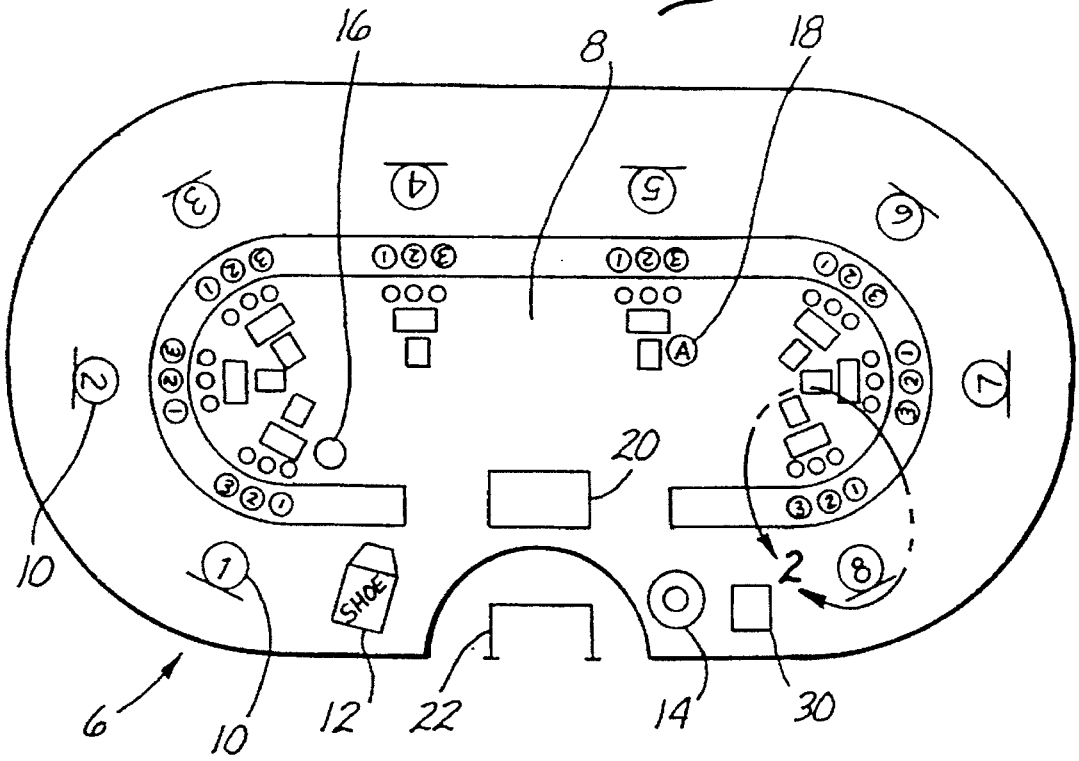
Fig. 2
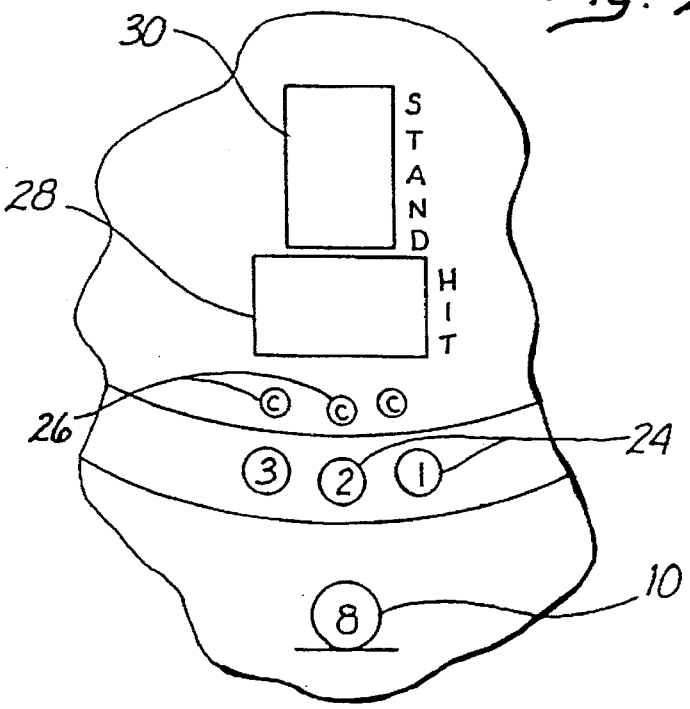
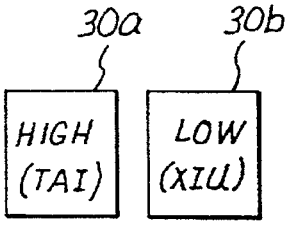
Fig. 3

METHOD OF PLAYING ASIAN HIGH-LOW CARD GAME

BACKGROUND OF THE INVENTION

1. Field of the Invention

The present invention generally relates to card games and, in particular, to card games utilizing customized decks of cards for use in casinos.

2. Description of Related Art

Card games have existed where players are dealt a number of cards and then have an option of receiving additional cards. The object of such a game is to score a predetermined number of points without going over this predetermined number. A well-known game where the object is to reach a value of twenty-one without going over this limit is Blackjack.

Applicants are aware of several card games which generally can be played in a casino-type environment. U.S. Pat. No. 5,072,946 to Miller discloses a casino-type card game involving two players. A card is dealt to each player, and when the numerical values of the cards are compared, a tie ends the game, or another card is dealt to the player with the lower numerical value hand. The player first reaching a predetermined numerical value eventually wins the game. Another patent, U.S. Pat. No. 5,265,882 to Malek discloses a casino-type card game wherein a player simultaneously plays at least two of three games against the dealer. This game is applicable to Twenty-One, modified Draw Poker, and Baccarat. U.S Pat. No. 5,275,415 to Wisted discloses a Blackjack-type game among a plurality of players playing against each other with a dealer. The dealer, however, does not receive any cards. A final card game to Schorr et al., U.S. Pat. No. 5,275,416, discloses a Blackjack-type card game with at least one customer wagering a first bet on any one of a dealer betting station corresponding to the "dealer hand," a player betting station corresponding to the "player hand," and a tie betting station. None of these games, however, use modified card decks in combination with customized playing rules, as does the present invention.

SUMMARY OF THE INVENTION

The method of playing a card game of the present invention is operated among a plurality of players arranged about a table. The method uses a card deck of 360 cards which consists of 15 modified conventional decks. Each modified conventional deck comprises aces, twos, threes, fours, fives, and sixes. Each modified conventional deck has all seven, eight, nine, ten, Jack, Queen, and King cards removed therefrom. Thus, each modified conventional deck comprises only 24 cards. Alternatively, a conventional 52 card deck, a deck with an added joker, or a set of 24 tiles (corresponding to the modified conventional deck) may be used. According to the method of the present invention, each of the plurality of players places a wager.

The card game is played according to either a high winning scheme or a low winning scheme. The banker may arbitrarily choose either winning scheme, or the winning scheme may be determined by a roll of the dice. After the winning scheme is determined, the banker rolls the three dice to determine the assignment of an action button to a second player. The assignment of the action button to the second player is determined from the number indicated by the rolled dice. The first round of two cards is dealt face down to all players (betting players and banker). After all players have received their two cards, the players inspect their hands and determine whether an additional card is desired. This determination will likely be affected by whether the high winning scheme or the low winning scheme has been set. Any additional cards are dealt, beginning with a player seated to the immediate left of the banker. The hands of the various players are then compared with the hands of the banker, and winners are declared who have hands that are better than the banker's hand, according to the selected predetermined winning scheme.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

FIG. 1 shows a preferred layout of the card table of the present invention which is used in connection with the method of the present invention;

FIG. 2 is a close-up view of the playing area in front of a player position according to the presently preferred embodiment; and FIG. 3 shows two sides of the declare button, that is used to indicated whether the high winning scheme or the low winning scheme is being used.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein.

FIG. 1 shows the table 6 of the presently preferred embodiment which comprises a playing surface 8 located in a central portion thereof. Eight player positions 10 are positioned about the periphery of the table 6, and a house dealer's position 22 is positioned between two of the player positions 10. The house dealer's tray 20 is positioned in front of the house dealer's position 22. The house dealer's tray 20 can store chips used during play of the game of the presently preferred embodiment. A bank button 16 is positioned in front of one of the player positions 10 to indicate which player is currently serving as banker. Similarly, an action button 18 is positioned in front of one of the player positions 10 to indicate which player will first receive two cards and first compare his hand with the hand of the house dealer 22. A cup, dice, and saucer 14 are provided to the right of the house dealer's position 22 on the playing surface 8.

The declare button 30 is positioned on the right hand side of the house dealer's position 22. The player banker can arbitrarily declare to play the game with either a high winning scheme or a low winning scheme. Alternatively, the determination of whether a high winning scheme or a low winning scheme is to be used may be made by a roll of the dice. According to this approach, three dice are given to the banker, the banker shakes the three dice, and the house dealer opens the cup to display the sum of the three dice. If the sum of the three dice is between three and ten, the low winning scheme is used. If the sum of the three dice is between eleven and eighteen, the high winning scheme is used.

FIG. 2 shows a close-up view of the playing area in front of each player position 10. Wager circles 24 accommodate wagers, and collection circles 26 accommodate corresponding collections, as described in copending application "Method of Playing a Card Game," U.S. Ser. No. 08/376,406, by one of the same inventors of this application. The hit box accommodates cards when the corresponding player wishes to draw another card, and the stand box accommodates the player's cards when the player does not wish to draw additional cards.

FIG. 3 shows the declare button 30 of FIG. 1. A first side 30*a* of the declare button indicates that the high (tai) winning scheme is being used, and the second side 30*b* of the declare button indicates that the low (xiu) winning scheme is being used.

The card shoe 12 accommodates a unique deck of 360 cards. Although the method of the presently preferred embodiment may be similar to the commonly-played game of Blackjack in that the goal of the game is to reach a predetermined number of points, the specific deck of cards and other various rules provide significant distinguishing features over this prior art. For example, the deck of 360 cards consists of 15 modified conventional card decks. Each conventional deck has aces, twos, threes, fours, fives, and sixes of spades, hearts, diamonds and clubs, but does not have any seven, eight, nine, ten, Jack, Queen and King cards. Each deck has 24 cards only, and aces count as one point only. Alternatively, a conventional 52 card deck, a deck with an added joker(s), or a set of 24 tiles (corresponding to the 24 card deck) can be used.

According to the method of the presently preferred embodiment, each player places a wager in one or more of the wager circles 24 and a required fee and one or more of the collection circles 26, as described in copending application "Method of Playing a Card Game," U.S. Ser. No. 08/376,406, by one of the same inventors. The player to the immediate left of the house dealer's position is first assigned the bank button 16 to indicate that the first player is presently serving as banker. This first player serves as banker for two games, and then the bank button 16 is given to a player to the left of the first player for two games. There are two ways to play the game: the player banker can declare to play the game high or low. The other way to play the game depends on the total outcome of three shaken dice, where from three to ten is the low winning scheme and from eleven to eighteen is the high winning scheme. The house dealer then gives the cup and the dice to the player with the bank button 16 and that player rolls the dice to determine assignment of the action button 18. If the sum of the three rolled dice is five, for example, a player five positions to the left of the house dealer's position 22 receives the action button 18.

The house dealer begins dealing cards to the players in a clockwise manner starting with the player having the action button 18. A total of two cards are dealt to each of the players, which totals two clockwise passes by the dealer. After these two passes, each player has two cards face down (including betting players and player banker).

The various players take their hands (each hand comprising two cards) and inspect them, determining whether an additional card is desirable. Beginning with the player to the left of the banker, players are given the opportunity to have additional cards dealt from the house dealer. If a player does not want additional cards, he places his cards in the stand box 30. On the other hand, if a player wishes to have an additional card dealt to him, then he places his cards in the hit box 28. The house dealer opens the banker's cards, placing them face up for all of the players to view, and the banker determines whether an additional card is desired for his hand.

According to the method of the presently preferred embodiment, the cards in the customized deck of 360 cards are assigned values according to the following scheme: all aces are counted as one, and numbered cards from two to six are counted as their indicated values. Suits are ignored. The objective of the game is to make a hand as close to twelve or lower for the high winning scheme, and to make a hand as close to two or higher for the low winning scheme. Thus, the best possible hand will have a total value of cards equalling twelve points for the high game, and will have a total of two for the low game. An instant winner will have two cards of 6 for the high and two cards of aces of the low.

Each player is thus originally dealt two cards, and has an option of taking a third card. If a player decides to take a third card and the resulting total of the player's three cards exceeds twelve, then eleven is automatically subtracted from the total of the player's hand when the high winning scheme is being used. Thus, for example, a player may receive a six and a five for the first two cards, and may decide to receive a third card. If this third card is a three, for example, then the original total would be fourteen. According to the preferred embodiment, eleven is subtracted from this total of fourteen, resulting in a score of three. The ranking order of this high winning scheme is as follows: twelve, eleven, ten, nine, eight, seven, six, five, four, three, two, with twelve being preferred and two being least preferred. A similar action follows with the low winning scheme. A player originally having a four and six for the first two cards, for example, may decide to accept a third card, which may be a four, for example. Thus, the original total of the player's three cards is fourteen, and eleven is subtracted, resulting in a score of three. The ranking order for the low winning scheme is as follows: two, three, four, five, six, seven, eight, nine, ten, eleven, and twelve.

According to the present invention, once a winning scheme has been determined, the winning scheme applies to all of the players. After each player is dealt the first two cards face down, each player can decide whether to accept one additional card in an attempt to improve their hands. The logical determination of whether the banker should accept this third card or not is now described. The banker must hit on a total of seven or lower, and must stay on a total of eleven or twelve. The banker has an option to accept a third additional card when the first two cards add up to eight, nine, or ten for the high winning scheme. In the low winning scheme, on the other hand, the banker must hit on eleven or higher, and must stay on seven or lower. According to this winning scheme, the banker has an option of hitting on an eight, nine, or ten for the low winning scheme. The logical procedure for determining whether a betting player should accept a third card or not, is now described. For the high winning scheme, the betting player should hit on eight or lower, and should stay on nine or higher. When the low winning scheme is being implemented, the betting player should hit on ten or higher, and should stay on nine or lower.

Since the player having the action button 18 is allowed to compare his cards with those of the player having the bank button 16 first, the player having the action button 18 has the highest probability of winning or losing money. The amount of money represented by chips in the wager circles 24 in front of the player having the bank button 16 represents the total amount of money available to be won during any given game. Thus, if the player having the action button 18 wins all of the money in the banker's wager circles 24, then there is no money left for the other players to win. Accordingly, the other players are entitled to a refund of the money in their collection circles 27. Details of this protocol are described in copending application "Method of Playing a Card Game," Ser. No. 08/376,406, by one of the same inventors of this application.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A method of playing a card game among a plurality of players arranged in a circular fashion, a dealer being positioned between two of the players, the method comprising the following steps:

providing a composite deck of cards, the composite deck of cards comprising at least one modified deck of cards which is modified by removing all seven, eight, nine, ten, Jack, Queen, and King cards from a conventional deck of cards;

placing a wager by each of the players;

a first player among the plurality of players being assigned the title of banker;

determining whether a first winning scheme is to be used or a second winning scheme is to be used;

providing at least one decision piece to the banker, the banker using the decision piece to determine an assignment of an action button;

assigning to a second player among the plurality of players the action button, the assignment of the action button to the second player being based upon a number generated by the use of the decision piece;

dealing by the dealer a first round of at least one card to each of the plurality of players in rotation;

determining by each of the players whether zero or at least one additional card is desired;

dealing by the dealer a second round of cards to any player in rotation who wants a card; and comparing the hands of the banker to each of the players' hands and declaring as winners players having hands that meet the determined winning scheme.

2. The method of playing a card game among a plurality of players according to claim 1, wherein the at least one modified deck of cards comprises 24 cards.

3. The method of playing a card game among a plurality of players according to claim 2, wherein the composite deck is modified from 15 conventional decks of cards.

4. The method of playing a card game among a plurality of players according to claim 3, wherein the composite deck comprises 360 cards.

5. The method of playing a card game among a plurality of players according to claim 1, wherein the determining step comprises a substep of the banker determining whether the first winning scheme is to be used or the second winning scheme is to be used.

6. The method of playing a card game among a plurality of players according to claim 5, wherein the determining step comprises a substep of rolling dice.

7. The method of playing a card game among a plurality of players according to claim 6, wherein the substep of rolling dice comprises the following substeps:

the dealer handing a cup of dice to the banker;

the banker shaking the dice and placing the cup upside down; and the house dealer opening the cup and determining, based on a value of the dice, whether the first winning scheme is to be used or the second winning scheme is to be used.

8. The method of playing a card game among a plurality of players according to claim 7, wherein a button is displayed to indicate the house dealer's determination.

9. The method of playing a card game among a plurality of players according to claim 1, wherein the determining step comprises a substep of the banker determining whether the first winning scheme is to be used or the second winning scheme is to be used.

10. The method of playing a card game among a plurality of players according to claim 9, wherein the banker's determination is made arbitrarily.

11. The method of playing a card game among a plurality of players according to claim 10, wherein a button is displayed to indicate the banker's determination.

12. The method of playing a card game among a plurality of players according to claim 1, wherein the first winning scheme is a "high" winning scheme that assigns a higher priority to greater sums of cards than to smaller sums of cards.

13. The method of playing a card game among a plurality of players according to claim 12, wherein the high winning scheme assigns a "best hand" to be a total of twelve, and a "worst hand" to be a total of two, the high winning scheme being set forth fully from best to worst, in descending order, as follows: twelve, eleven, ten, nine, eight, seven, six, five, four, three, two.

14. The method of playing a card game among a plurality of players according to claim 13, wherein a sum greater than twelve automatically has eleven subtracted therefrom.

15. The method of playing a card game among a plurality of players according to claim 1, wherein the second winning scheme is a "low" winning scheme that assigns a lower priority to greater sums of cards than to smaller sums of cards.

16. The method of playing a card game among a plurality of players according to claim 15, wherein the low winning scheme assigns a "best hand" to be a total of two, and a "worst hand" to be a total of twelve, the second winning scheme being set forth fully from best to worst, in descending order, as follows: two, three, four, five, six, seven, eight, nine, ten, eleven, twelve.

17. The method of playing a card game among a plurality of players according to claim 16, wherein a sum greater than twelve automatically has eleven subtracted therefrom.

18. A method of playing a card game among a plurality of players arranged in a circular fashion, a dealer being positioned between two of the players, the method comprising the following steps:

providing a composite deck of cards, the composite deck of cards corresponding at least in part to at least one conventional deck of cards;

placing a wager by each of the players;

a first player among the plurality of players being assigned the title of banker;

determining whether a first winning scheme is to be commonly used by all the players and banker or a second winning scheme is to be commonly used by all the players and banker;

providing at least one decision piece to the banker, the banker using the decision piece to determine an assignment of an action button;

assigning to a second player among the plurality of players the action button, the assignment of the action button to the second player being based upon a number generated by the use of the decision piece;

dealing by the dealer a first round of at least one card to each of the plurality of players in rotation;

determining by each of the players whether zero or at least one additional card is desired;

dealing by the dealer a second round of cards to any player in rotation who wants a card, seated to the immediate left of the first player; and comparing the hands of the banker to each of the players' hands and declaring as winners players having hands that meet the determined winning scheme.

19. The method according to claim 18 wherein the conventional deck of cards further includes a joker card.

20. A method of playing a card game among a plurality of players arranged in a circular fashion, a dealer being positioned between two of the players, the method comprising the following steps:

providing a composite deck of cards, the composite deck of cards at least in part to at least one modified deck of cards which is modified by removing all seven, eight, nine, ten, Jack, Queen, and King cards from a conventional deck of cards;

placing a wager by each of the players;

a first player among the plurality of players being assigned the title of banker;

determining whether a first winning scheme is to be used or a second winning scheme is to be used;

providing at least one decision piece to the banker, the banker using the decision piece to determine an assignment of an action button;

assigning to a second player among the plurality of players the action button, the assignment of the action button to the second player being based upon a number generated by the use of the decision piece;

dealing by the dealer a first round of at least one card to each of the plurality of players in rotation;

determining by each of the players whether zero or at least one additional card is desired;

dealing by the dealer a second round of cards to any player in rotation who wants a card; and comparing the hands of the banker to each of the players' hands and declaring as winners players having hands that meet the determined winning scheme, wherein the first winning scheme is a "high" winning scheme that assigns a higher priority to greater sums of cards than to smaller sums of cards, the high winning scheme assigning a "best hand" to be a total of twelve, and a "worst hand" to be a total of two, the high winning scheme being set forth fully from best to worst, in descending order, as follows: twelve, eleven, ten, nine, eight, seven, six, five, four, three, two, and wherein the second winning scheme is a "low" winning scheme that assigns a lower priority to greater sums of cards than to smaller sums of cards, the low winning scheme assigning a "best hand" to be a total of two, and a "worst hand" to be a total of twelve, the second winning scheme being set forth fully from best to worst, in descending order, as follows: two, three, four, five, six, seven, eight, nine, ten, eleven, twelve.

21. A method of playing a tile game among a plurality of players arranged in a circular fashion, a dealer being positioned between two of the players, the method comprising the following steps:

providing a composite set of tiles, the composite set of tiles corresponding at least in part to at least one modified deck of cards which is modified by removing all seven, eight, nine, ten, Jack, Queen, and King cards from a conventional deck of cards;

placing a wager by each of the players;

a first player among the plurality of players being assigned the title of banker;

determining whether a first winning scheme is to be used or a second winning scheme is to be used;

providing at least one decision piece to the banker, the banker using the decision piece to determine an assignment of an action button;

assigning to a second player among the plurality of players the action button, the assignment of the action button to the second player being based upon a number generated by the use of the decision piece;

dealing by the dealer a first round of at least one tile to each of the plurality of players in rotation;

determining by each of the players whether zero or at least one additional tile is desired;

dealing by the dealer a second round of tiles to any player in rotation who wants a tile seated to the immediate left of the first player; and comparing the hands of the banker to each of the players' hands and declaring as winners players having hands that meet the determined winning scheme.

22. A method of playing a tile game among a plurality of players arranged in a circular fashion, a dealer being positioned between two of the players, the method comprising the following steps:

providing a composite set of tiles, the composite set of tiles corresponding at least in part to at least one conventional deck of cards;

placing a wager by each of the players;

a first player among the plurality of players being assigned the title of banker;

determining whether a first winning scheme is to be commonly used by all the players and banker or a second winning scheme is to be commonly used by all the players and banker;

providing at least one decision piece to the banker, the banker using the decision piece to determine an assignment of an action button;

assigning to a second player among the plurality of players the action button, the assignment of the action button to the second player being based upon a number generated by the use of the decision piece;

dealing by the dealer a first round of at least one tile to each of the plurality of players in rotation;

determining by each of the players whether zero or at least one additional tile is desired;

dealing by the dealer a second round of tiles to any player in rotation who wants a tile; and comparing the hands of the banker to each of the players' hands and declaring as winners players having hands that meet the determined winning scheme.

* * * * *